US005758809A

United States Patent [19]

Bonner

[11] Patent Number: 5,758,809

[45] Date of Patent: Jun. 2, 1998

[54] CORD HOLDING HARNESS

[76] Inventor: James D. Bonner, 3416 Mark La., Norton, Ohio 44203

[21] Appl. No.: 557,357

[22] Filed: Nov. 13, 1995

[51] Int. Cl.[6] ..... A41F 19/00

[52] U.S. Cl. ..... 224/259; 224/268

[58] Field of Search ..... 224/259, 264, 224/268, 902, 602, 603; 2/300, 323, 326, 94

[56] References Cited

U.S. PATENT DOCUMENTS

| | | | |
|---|---|---|---|
| 394,721 | 2/1888 | Pell et al. | 224/602 X |
| 1,143,825 | 6/1915 | Hausammann | 224/602 X |
| 2,855,133 | 10/1958 | Mullin | 224/259 X |
| 3,809,349 | 5/1974 | Baedke | 224/268 X |
| 3,862,709 | 1/1975 | Roshaven | 224/264 |
| 4,756,458 | 7/1988 | Clifton | 224/603 |
| 4,764,962 | 8/1988 | Ekman et al. | 224/259 X |
| 5,024,360 | 6/1991 | Rodriguez | 2/94 X |

*Primary Examiner*—Renee S. Luebke
*Attorney, Agent, or Firm*—Reese Taylor

[57] ABSTRACT

A cord holding harness includes a suspender-like strap arrangement fitting over the upper torso of the user and has a sleeve attached to one of the straps carrying a hook for engaging the cord of an appliance. A clip is attached to the straps so as to be normally positioned at the back of the wearer when the harness is in place so that the electrical cord of a tool or appliance can be retained out of the way of the appliance user.

4 Claims, 3 Drawing Sheets

CORD HOLDING HARNESS

BACKGROUND OF THE INVENTION

This invention relates in general to electrically-powered tools and relates in particular to a harness intended to be used with such tools, wherein the electrical cord attached to the tool is safely and securely positioned out of the way of the user.

DESCRIPTION OF THE PRIOR ART

A wide variety of electrically-powered tools, such as buffers, hedge trimmers, etc., are commonly utilized by professionals as well as handymen of all types. Unless battery powered, these tools or appliances all include an electrical cord which is plugged into a wall outlet at one end and attached to the appliance or tool at the other end to provide the driving force for the appliance.

In many instances, however, the cord itself becomes cumbersome and gets in the way of operation of the device. For example, when the tool or appliance is a buffer for buffing cars, the buffer is held in the hands of the user and applied to the surface of the vehicle. However, the cord simply dangles from the end of the tool and is often in the way of the operator. Alternatively, the cord is commonly thrown over the operator's shoulder and is prone to slipping off and interfering with operation of the tool or appliance.

Additionally, in the case of a buffer, for example, wherein the object is to provide a nice, clean, smooth, unimpaired finish to the vehicle, the cord is subject to being dragged across the surface of the vehicle and impacting it, thereby leaving marks and defeating the purpose of the operation.

In the use of other appliances, such as a hedge trimmer, for example, not only does the uncontrolled cord interfere with the operator, but presents a danger, inasmuch as it is often the case that these cords come into contact with the blades of the appliance, thereby either completely severing the cord or breaking through the insulation and creating a hazard to the user.

Accordingly then, it is believed desirable to provide a means for facilitating the use of tools or appliances of this type by means of which the electrical cord can be safely and securely positioned out of the way of the user.

SUMMARY OF THE INVENTION

It has been found that the aforementioned object can be achieved by providing a harness which can be removably secured to the torso of the user and which carries two engagement means for engaging the cord and maintaining it out of the way of the user. Such a harness may be of the type generally resembling suspenders which are secured in the front and rear of the user's trousers or belt and which include straps passing over the shoulders.

In furtherance of this object, it has been found that one of these engagement means may comprise a clipping hook positioned in the back of the wearer when the harness is in place and which first engages and holds the cord in a relatively stable position relative to the body of the wearer.

It has also been found that a second engagement means can be affixed to one or both of the straps of the harness and can be made adjustable to accommodate the desires of the wearer. This second engagement means includes a sleeve, slidably received on the strap and carrying a retaining hook to engage the cord, thereby keeping the cord out of the way of the operator without limiting the operator's scope of operation in any way.

Finally, it has been found that an accessory pouch can be affixed to the harness, preferably at the rear, so as to provide ready access to accessory items while storing them out of the working area when not in use.

Accordingly, production of an improved harness of the type above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
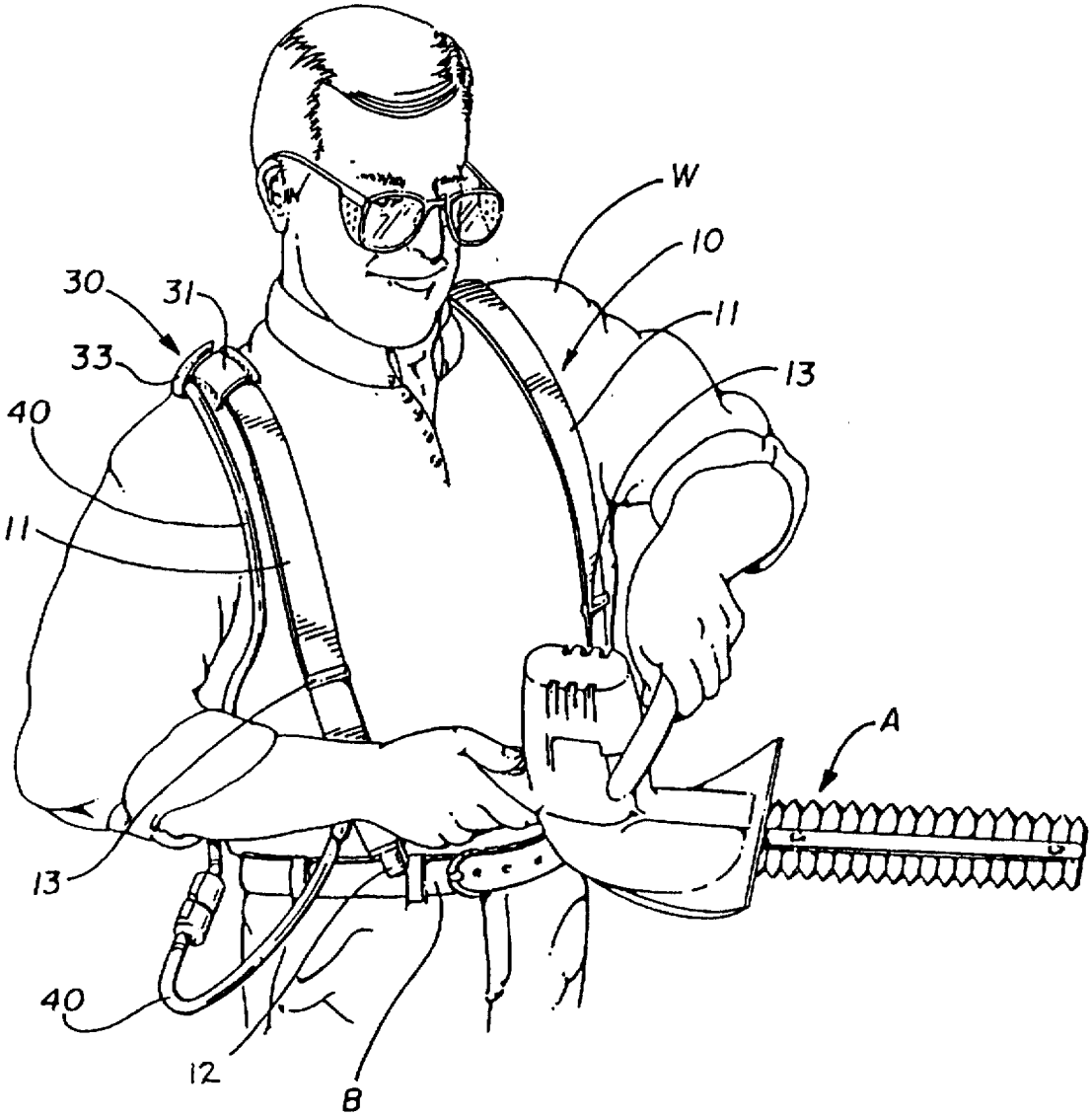
FIG. 1 is a perspective view showing the improved harness in place on the wearer.

Referring first to FIG. 1 of the drawings, it will be seen that the harness, generally indicated by the numeral 10, is constructed similar to conventional suspenders and includes straps 11,11 and clips 12,12 which can be attached to the belt B or trousers of the wearer so as to secure the straps in place, front and rear. The straps, which extend over the shoulders of the wearer, may be adjustable, as indicated at 13,13, so that the straps can be lengthened or shortened to fit the individual wearer.

Figure 2:
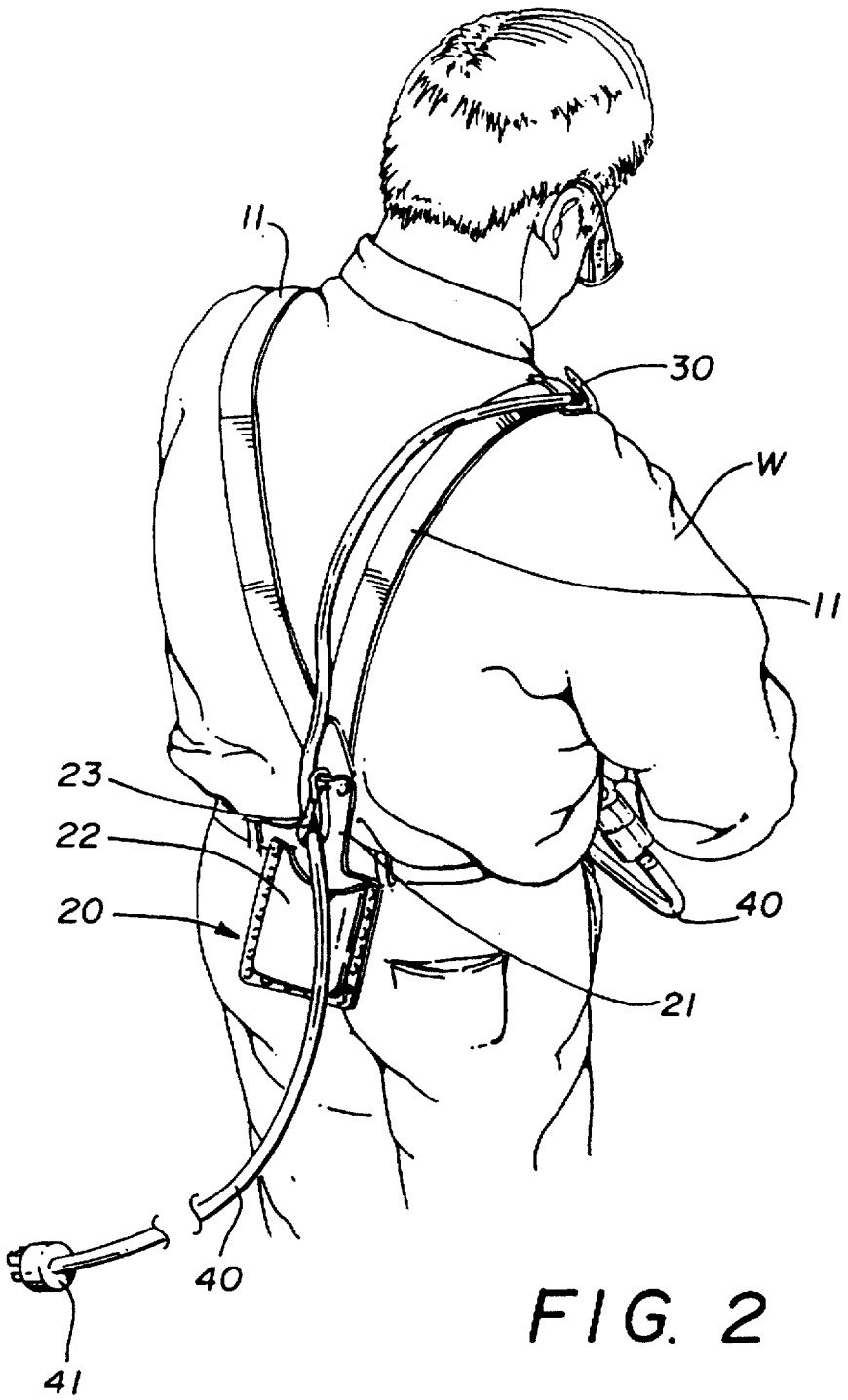
FIG. 2 is a view similar to FIG. 1 taken from the rear of the wearer and showing the harness in place.

In FIGS. 1 and 2 of the drawings, the harness 10 is shown in place on a wearer W and the wearer is shown operating an appliance which, in the drawings, is illustrated as a hedge clipper, but which obviously could be any electrically-driven appliance. As illustrated, one end of cord 40 is attached to the appliance A and the other end carries a plug 41 which can be inserted into a wall receptacle (not shown) in conventional fashion.

Figure 5:
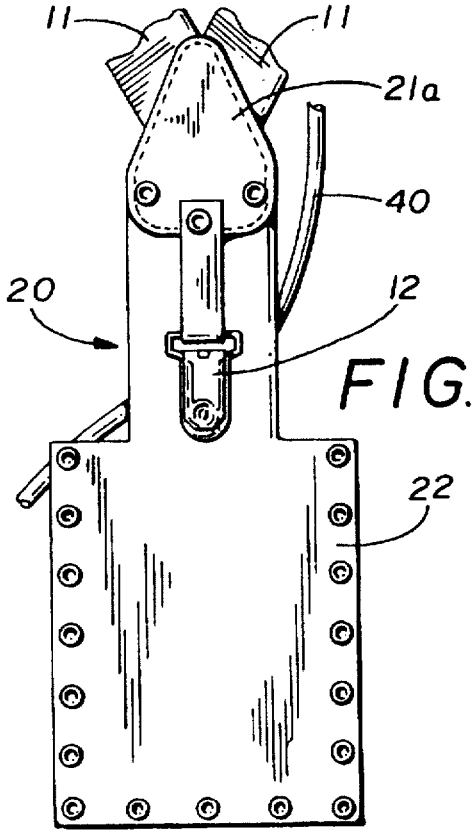
FIG. 5 is a rear elevational view showing an accessory tool pocket attached to the harness.
Figure 6:
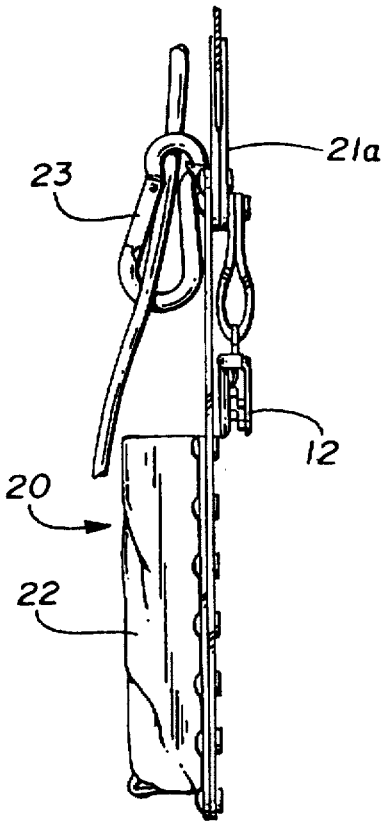
FIG. 6 is a side elevational view showing the accessory tool pocket attached to the harness.

The harness 10 carries a first engagement means 20, as shown in FIG. 2. The first engagement means 20 includes a generally elongate base flap 21, one end 21*a* of which is attached to the harness strap, as can be seen in FIGS. 2 and 5 of the drawings. The base flap 21 has, on its forward surface, a pocket cover 22, as can be seen in FIG. 6 and which forms a pouch or receptacle for the receipt of an accessory which may or may not be utilized with appliance A. In any event, it will be noted that the pouch or receptacle is disposed behind the wearer so as to be readily accessible, but so as to also be in a position in which it will not interfere with use of the appliance.

It will be noted in the drawings that cover 22 is secured to base flap 21 by rivets, but the same could also be secured by other means, such as adhesive, stitching, etc., or could be made from a single piece of material. In that regard, the invention is not intended to be limited to any particular material and, for example, base flap 21 and cover 22 could be fabricated of leather, plastic, etc.

Also secured to base flap 21 is a clip 23, as can be seen in FIGS. 2 and 6 of the drawings. This clip is a snap-type clip which is attached to the base flap 21 adjacent the belt line of the wearer and the point of attachment of the straps to the belt or trousers of the wearer. The cord 40 is received within this clip 23 and this positions the cord at the rear of the wearer and keeps it more or less in place laterally, although permitting some longitudinal or axial movement. In this way, the cord may extend over the shoulder of the user, but is prevented from inadvertent movement and from coming into contact with either the article upon which the tool is employed or with the tool itself, such as in the case of the hedge trimmer.

Figure 3:
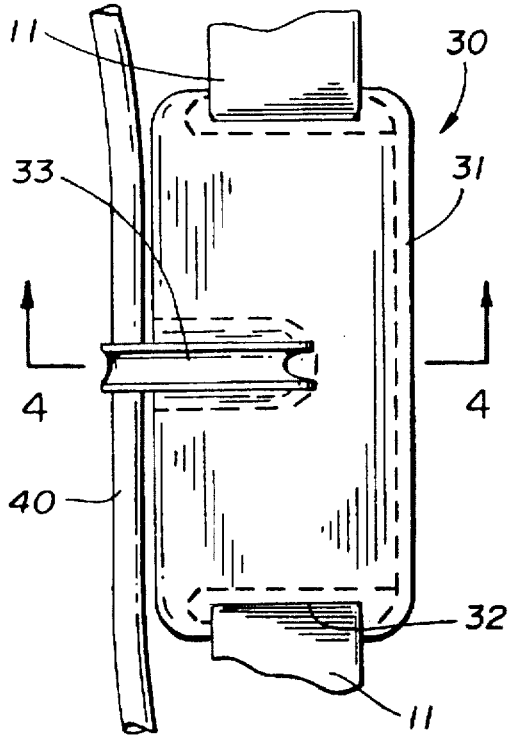
FIG. 3 is an enlarged elevational view showing the strap-engaging hook apparatus.
Figure 4:
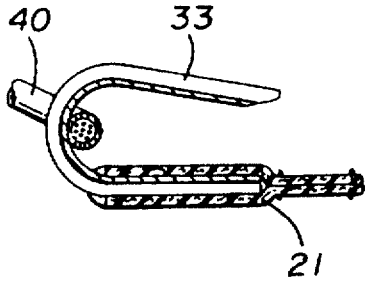
FIG. 4 is a sectional view taken along the line 4—4 of FIG. 3 and showing the strap-engaging hook apparatus.

The harness 10 also carries a second attachment means 30, as shown in FIGS. 1 and 3 of the drawings. This second engagement means includes a sleeve 31 with a through opening 32 centrally located therein. Affixed to the sleeve 31 is a hook 33 and, as illustrated in FIGS. 1, 3 and 4 of the drawings, the cord 40 can simply be slipped under this hook and will be capable of sliding longitudinally, but prevented from inadvertent dislodgement.

It will be noted that sleeve 31 is illustrated as being comprised of two stitched-together pieces, but other means for securing the pieces to each other could be employed or the sleeve could be fabricated from one piece of material if desired. Also, and while the invention is not intended to be limited by the material from which its components are fabricated, the sleeve may desirably be made of rubber or some other material having a high coefficient of friction to assist in maintaining its position on the body of the wearer.

It is also contemplated that the second engagement means 30 could be removably attached to the strap 11 so that it could be interchanged from the strap going over the right shoulder to the one going over the left shoulder in the event the user happens to be left handed. Alternatively, one such means could be attached to each strap 11.

In use or operation of the improved cord holding apparatus, the wearer would first don the harness 10 and secure it, by means of clips 12,12, to his or her belt or trousers. Adjustment for fit can then be made by the adjustment means 13,13. The sleeve 31 can then be positioned on the shoulder of the wearer and the appliance cord 40 can then be engaged by the clip 23 and hook 33, and the plug 41 can be plugged into the power source. The wearer is then free to operate the appliance safely and without hinderance from the cord 40. It will be noted that the harness is illustrated with the front straps in parallel. If desired, either for the comfort of the wearer or to add to the security of the placement of the sleeve 31, they could be crisscrossed.

While a full and complete description of the invention has been set forth in accordance with the dictates of the Patent Statutes, it should be understood that modifications can be resorted to without departing from the spirit hereof or the scope of the appended claims.

What is claimed is:

1. A cord holding harness, comprising:

(a) a pair of straps, each strap having a first end and a second end, said straps being joined at said second ends;

(b) first engagement means carried by said straps adjacent said second ends and releasably and slidably engaging the cord;

(c) second engagement means adjustably carried by one of said straps, said second engagement means releasably and slidably engaging the cord; and (d) said first engagement means includes a base flap attached to said second ends of said straps, a cover secured to said base flap and forming a pocket therewith, and a clip for engagement with the cord.

2. A cord holding harness, comprising:

(a) a pair of straps;

(b) a hook carried by at least one of said straps for slidably holding the cord;

(c) a clip carried by at least one of said straps for slidably holding the cord;

(d) a pocket carried by at least one of said straps; and (e) each of said straps having a first end and a second end;

(f) said straps being joined at said second end; and (g) said pocket being disposed at said second ends of said straps.

3. The cord holding harness of claim 2 wherein said clip is carried by at least one of said straps at said second end of said at least one of said straps.

4. A cord holding harness to be worn on an upper portion of a person's body, comprising:

(a) a pair of shoulder straps, each strap having a first end and a second end;

(b) a garment clip connected to each end of each of said straps;

(c) a hook adjustably carried by at least one of said straps for releasably and slidably holding the cord;

(d) a clip carried by at least one of said straps for releasably and slidably holding the cord;

(e) a base flap attached to said second ends of said straps; and (f) a cover secured to said base flap and forming a pocket therewith.

* * * * *